United States Patent [19]

Asick et al.

[11] 4,453,798

[45] Jun. 12, 1984

[54] SHIELDED CABLE ON COAXIAL CONNECTOR

[75] Inventors: John C. Asick, Harrisburg; John M. Landis, Camp Hill; Clair W. Snyder, Jr., York, all of Pa.

[73] Assignee: AMP Incorporated, Harrisburg, Pa.

[21] Appl. No.: 389,745

[22] Filed: Jun. 18, 1982

[51] Int. Cl.[3] ..... H01R 13/506; H01R 13/648

[52] U.S. Cl. ..... 339/143 R; 174/35 C

[58] Field of Search ..... 339/143 R, 141, 136 R, 339/107, 103 R, 103 M, 177 R, 177 E; 174/35 C

[56] References Cited

U.S. PATENT DOCUMENTS

| | | | |
|---|---|---|---|
| 2,169,962 | 8/1939 | Delcamp | 339/143 R |
| 3,281,756 | 10/1966 | O'Keefe et al. | 339/143 R X |
| 3,569,915 | 3/1971 | Sorensen et al. | 339/143 R |
| 3,824,528 | 7/1974 | Esser | 339/177 R |
| 3,864,011 | 2/1975 | Huber | 339/103 M |
| 3,990,766 | 11/1976 | Volinskie et al. | 339/177 E |
| 4,111,513 | 9/1978 | Thursten et al. | 339/143 R |
| 4,243,288 | 1/1981 | Lucius et al. | 339/107 X |
| 4,337,989 | 7/1982 | Asick et al. | 339/143 R |

*Primary Examiner*—William R. Briggs

*Attorney, Agent, or Firm*—Russell J. Egan

[57] ABSTRACT

An electrical connector is disclosed for terminating coaxial cable and mating with a multi-pin array, having at least one signal pin and the rest ground pins and being mounted in a circuit board or the like. The connector has a housing carrying at least one terminal mounted to receive the signal wire of the cable and engage a respective signal pin of the array, and a pair of mating metal shells enclosing the housing, engaging the shielding of the cable, and, upon mating of the connector with the array, contacting the respective ground pins while allowing clear entry of the signal pin to engage the signal terminal.

3 Claims, 3 Drawing Figures

SHIELDED CABLE ON COAXIAL CONNECTOR

The present invention relates to an electrical connector for terminating coaxial cable in such a manner as to allow it to be intermated with a pin array wherein one of the pins is a signal pin and the remaining pins are ground pins.

Previous coaxial connectors have always required coaxial pin and socket assemblies with one terminating the coaxial cable and the other mounted on a device, such as a housing. This has not kept pace with the state of the art which is now requiring more and more use of shielded cable and shielded interconnections to prevent RF and EM interference. It is not always suitable to provide a circuit board, for example, with a coaxial socket since this frequently cannot meet space requirements, would use a substantial amount of board real estate, and would also substantially increase the expense of making such an interconnection.

The present invention is, therefore, intended as a connector for interconnecting a coaxial cable with a pin array on a circuit board or the like. The connector includes a housing having therein a plurality of terminals, at least one of which is adapted to terminate the signal wire of the coaxial cable. A pair of mating metallic shell members enclose the connector housing and mechanically and electrically engage the shielding of the cable. Each metal shell member includes a cantilevered extension which projects beyond the mating face of the connector and contains a plurality of apertures, only one of which is sufficiently larger than a mating pin terminal to avoid contact therewith. This enlarged aperture is aligned with the terminal of the housing which is connected to the signal conductor of the coaxial cable and receives the signal pin therethrough without contacting it.

The present invention will now be described by way of non-limiting example with reference to the accompanying drawings in which.

Figure 2:
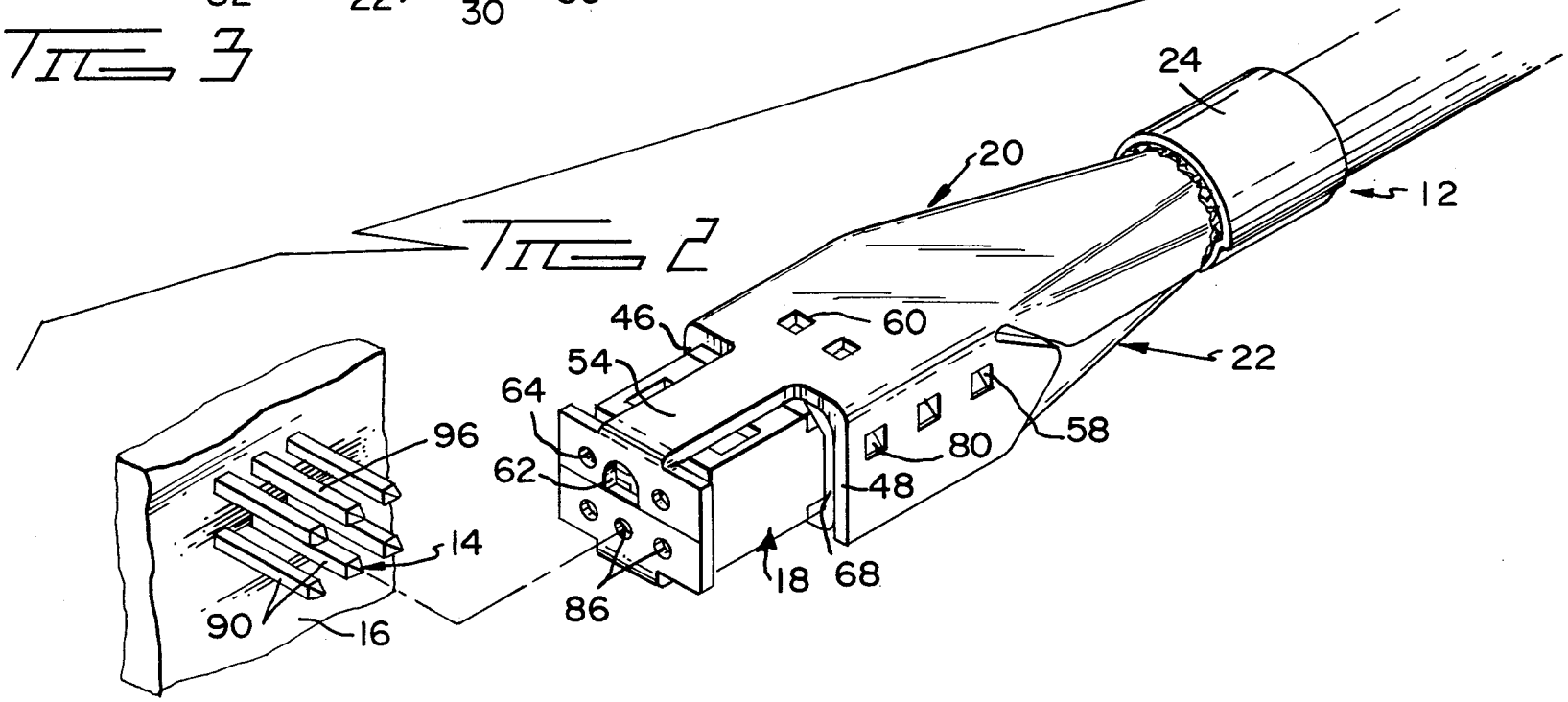
FIG. 2 is an assembled perspective view of the subject invention exploded from a pin array.

The subject connector assembly 10 is used to terminate a coaxial cable 12 and mate with a multi-pin array 14 on a circuit board 16 or the like (see FIG. 2). The connector assembly 10 is formed by a connector 18, of the type disclosed in U.S. Pat. No. 4,243,288, the disclosure of which is incorporated therein by reference, enclosed within metal shells 20, 22, and secured to the braid of the coaxial cable 12 by a crimp ferrule 24.

The connector 18 includes a housing 26 of rigid insulative material having a mating face 28 and an oppositely directed rear end 30 with a plurality of terminal passages 32 extending therebetween. Each passage 32 is fully enclosed toward the mating face 28 and outwardly open channel shaped toward the rear end 30. The rear end 30 of the housing 26 is enclosed within a pair of mating covers 34, 36. The housing 26 has a plurality of like terminals 38 mounted therein, each terminal lying in a respective terminal passage 32 with a receptacle portion 40 directed towards the mating face 28 and a conductor engaging portion 42 lying in the channel shaped rear end 30. The conductor engaging portion 42 is preferably of the slotted plate type and positioned beneath the respective covers 34, 36 so as to be accessible for easy insertion termination of the signal wire when the adjacent cover is removed.

The metal shells 20, 22 are each stamped and formed from metal stock and together define therebetween a chamber 44 which receives the connector 18 therein. The shell 20 has a pair of spaced depending sidewalls 46, 48, a tapered portion 50 leading to a cable barrel 52, a forwardly directed cantilever arm 54 with a transverse flange 56 on the free end thereof. The sidewalls 44, 48 are each provided with a plurality of apertures 58. Inwardly directed tines 60 are formed in the shell. The transverse flange 56 is profiled with a central recess 62 and includes at least one aperture 64 to one side of the recess 62. The shell 22 likewise has a pair of sidewalls 66, 68, a tapered portion 70, and a cable barrel 72. The sidewalls 66, 68 are formed with a plurality of tines 74, 76, respectively, giving each sidewall a comb-like appearance. Each tine 74, 76 has a respective outwardly directed lance 78, 80. The shell 22 also has a forwardly directed arm 82 having a transverse flange 84 on the free end thereof with the flange provided with a plurality of apertures 86.

The coaxial cable 12 is of the well known type having a signal conductor 88, insulation 90, braided insulation 92, and an insulating jacket 94.

Figure 1:
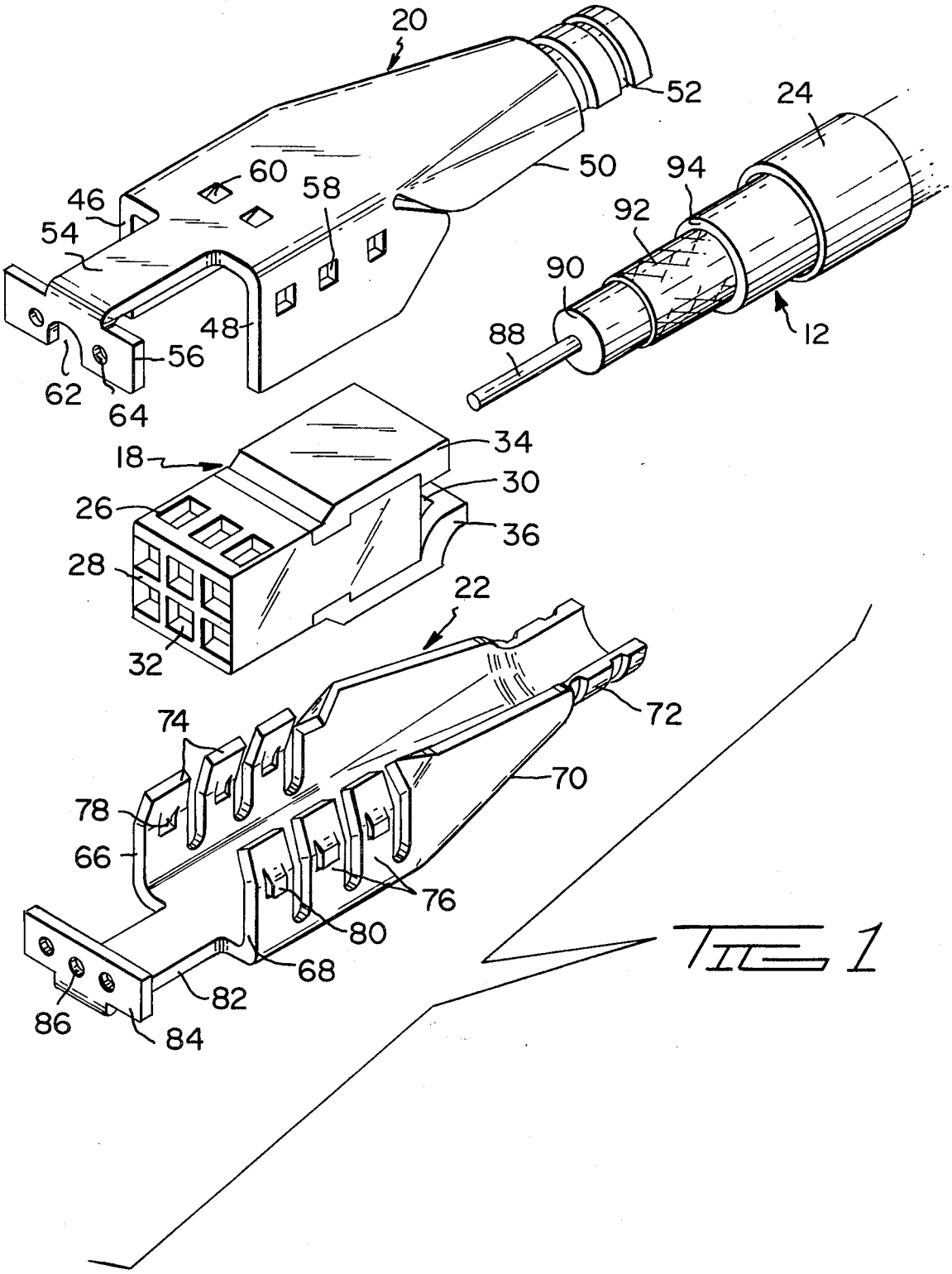
FIG. 1 is an exploded perspective view of the subject invention.
Figure 3:
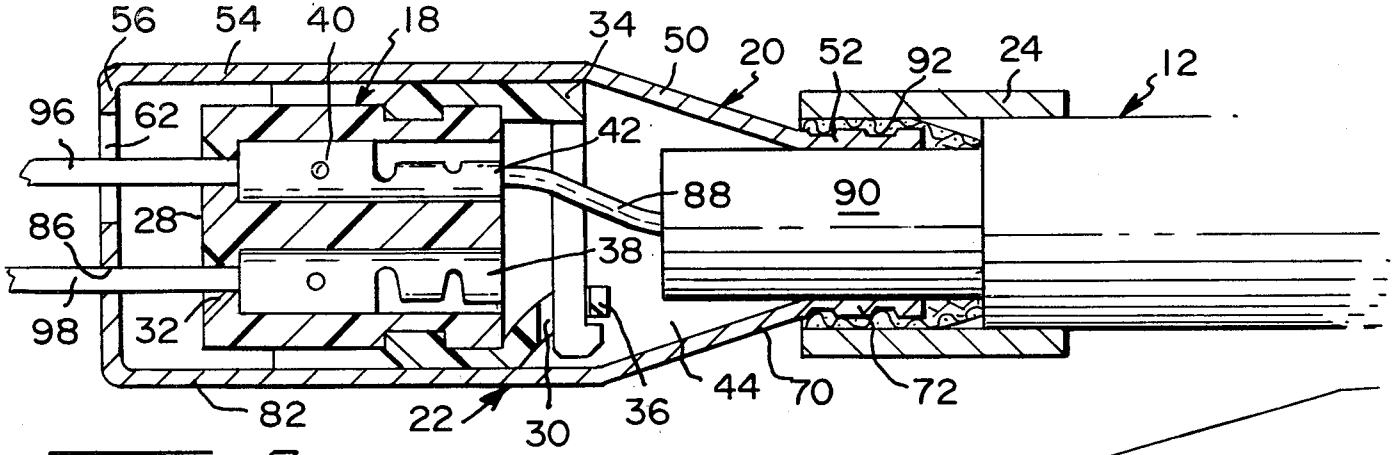
FIG. 3 is a longitudinal section through the connector according to the present invention.

The subject invention, as previously mentioned, is intended for mating coaxial cable 17 with an array 14 of terminal pins, as shown in FIGS. 2 and 3. The array 14 of terminal pins includes one pin 96 which is the signal pin while the remaining pins 98 are ground pins.

The present invention is assembled to a coaxial cable 12 by first sliding the crimp ferrule 24 onto the prepared cable 12. The signal conductor 88 is then terminated in the designated signal terminal 38 (see FIG. 3) and the covers 34, 36 are applied to the connector housing 26. The shells 20, 22 are then joined to enclose the connector 18. During the initial assembly of the shells 20, 22 the lances 78, 80 will engage in respective apertures 58 to secure the shells together. The tines 60 will also engage the housing 26 to properly position the connector 18 within the shells 20, 22. The cable barrels 52, 72 will overlie a portion of the insulation 96 and the braid 92 can be stretched over the barrels. The crimp ring 24 is then slipped into position over barrels 52, 72 and then crimped to tightly secure braid 92 of the cable 12 to the assembled shells. It will be noted from FIGS. 2 and 3 that when the connector 10 is fully assembled, the apertures 64, 86 and the recess 62 will be appropriately aligned in front of the terminal passages 32 of the connector 18 with the recess 62 being positioned in front of the terminated signal conductor 88 of the cable 12. When the completed connector assembly 10 is mated with the pin array 14, the ground pins 98 will make a wiping contact with the apertures 64, 86 to complete a ground path between the panel 16 and the braid 92 of the cable 12. The signal pin 96 will pass through the recess 62 out of contact therewith and will engage in the terminal receptacle 38.

The present invention has been shown in a two row six terminal configuration with the signal terminal being centermost on one row. It is well within the present invention to have other configurations of the array, to have multiple connectors mating with a continuous array, or even performing signal splitting by terminating the signal wire to two or more terminals.

We claim:

1. An electrical connector for making an interconnection between a coaxial cable and an array of pin terminals fixedly mounted in a circuit board or the like, one pin terminal of said array being a signal pin and the remaining pin terminals being ground pins, said connector having a housing with at least one terminal mounted therein and adopted to engage a signal conductor of said coaxial cable and to detachably mate with the signal pin terminal of said array, a pair of mating metal shells enclosing the connector, and means crimping the shielding of said cable to said shells characterized by arms integral with each respective shell member and extending forwardly of the connector, flanges on the free ends of the arms extending transversely thereto to define a plane in front of the mating front end of the connector, a plurality of apertures in said flanges each aligned to receive a respective pin terminal of said array, the aperture aligned with the signal pin terminal of said array and said signal terminal of said connector being significantly larger than the other apertures so that no contact will be made between the signal pin terminal and the adjacent metal shell in a mated condition of said connector.

2. A method for making electrical interconnection between a coaxial cable and an array of pin terminals fixedly mounted in a circuit board or the like, one pin terminal of said array being a signal pin and the remaining pin terminals being ground pins, comprising the steps of:

terminating the signal conductor of said coaxial cable with a terminal mounted in a connector housing, said terminal being aligned with the signal pin terminal of said array;

enclosing the connector in a pair of mating metal shell members, each respective shell member having at least one arm extending forwardly of the connector with flanges on the free ends of the arms extending transversely thereto to define a plane in front of the mating front end of the connector, apertures in said flanges each aligned to receive a respective pin terminal of said array and the aperture aligned with the signal pin terminal and signal terminal being significantly larger than the other apertures so that no contact will be made between the signal pin terminal and the adjacent metal shell in a mated condition of said connector assembly, and crimping the shielding of said coaxial cable to said shells whereby ground is established between said shielding and said ground pin terminals upon mating of said connector with said array.

3. An electrical connector for making an interconnection between a coaxial cable and an array of pin terminals fixedly mounted in a circuit board or the like, one pin terminal of said array being a signal pin and the remaining pin terminals being ground pins, said connector comprising:

a housing of rigid insulative material with a plurality of terminal passages extending from a front mating face to a rear surface, said passages being fully enclosed toward said mating face and channel shaped opening outwardly toward the rear surface;

at least one terminal mounted in a respective passage and adopted to engage a signal conductor of said coaxial cable and to detachably mate with the signal pin of said array, a cover closing the open portion of said passages;

a pair of mating metal shells enclosing the housing, each said shell having an integral arm extending forwardly of the connector, a flange on the free end of each arm extending transversely thereto to define a plane spaced from the mating front end of the housing, a plurality of apertures in each said flanges each aligned with a respective pin of said array and said terminal of said connector with the aperture aligned with the signal pin and signal terminal being significantly larger than the other apertures so that no contact will be made between the signal pin and the adjacent metal shell in a mated condition of said connector assembly; and a crimp ring securing shielding of said cable to said shells.

* * * * *